United States Patent [19]

Weimann

[11] Patent Number: 4,878,534

[45] Date of Patent: Nov. 7, 1989

[54] APPARATUS FOR THE COMPACTING OF GRANULAR MOLDING MATERIALS

[75] Inventor: Wendelin Weimann, Klettgau, Fed. Rep. of Germany

[73] Assignee: Georg Fischer AG, Schaffhausen, Switzerland

[21] Appl. No.: 292,772

[22] Filed: Jan. 3, 1989

[30] Foreign Application Priority Data

Jan. 8, 1988 [CH] Switzerland ..... 00058/88

[51] Int. Cl.[4] ..... B22C 15/00

[52] U.S. Cl. ..... 164/154; 164/169

[58] Field of Search ..... 164/38, 37, 169, 170, 164/171, 172, 173, 195-201, 207, 154

[56] References Cited

U.S. PATENT DOCUMENTS

| | | | |
|---|---|---|---|
| 2,864,136 | 12/1958 | Taccone | 164/171 |
| 4,063,586 | 12/1977 | Keller | 164/37 X |
| 4,750,540 | 6/1988 | Boenisch | 164/37 X |

FOREIGN PATENT DOCUMENTS

| | | | |
|---|---|---|---|
| 58-125339 | 7/1983 | Japan | 164/169 |
| 980928 | 12/1982 | U.S.S.R. | 164/169 |
| 982247 | 8/1983 | U.S.S.R. | 164/169 |
| 1052314 | 11/1983 | U.S.S.R. | 164/173 |

*Primary Examiner*—Nicholas P. Godici
*Assistant Examiner*—J. Reed Batten, Jr.
*Attorney, Agent, or Firm*—Bachman & LaPointe

[57] ABSTRACT

A process and apparatus for compacting granular molding materials in a mold cavity defined by a pattern plate, a mold box arranged thereon, a filling frame on the molding box and a pressure chamber comprises applying pressure to the exterior peripheral wall surfaces of the molding box which pressure acts in opposition to the compacting pressure applied to the granular materials in the mold cavity. The pressure applied to the exterior walls of the molding box is independent of the compacting pressure applied over the granular molding materials.

6 Claims, 1 Drawing Sheet

APPARATUS FOR THE COMPACTING OF GRANULAR MOLDING MATERIALS

BACKGROUND OF THE INVENTION

The invention relates to a process for compacting granular molding materials and an apparatus necessary for implementation of the process.

Swiss Patent Specification No. 657,792 discloses a process and an apparatus for compacting granular molding material. The apparatus comprises a second frame which is arranged around the molding box and together with a hood arranged above the second frame, forms a pressure chamber. In the intermediate space between the molding box and the frame of the pressure chamber there is arranged either the granular material, such as for example molding material, or a liquid or pasty mass in a flexible cover. Consequently, the compacting pressure generated in the pressure chamber also acts on the outer walls of the molding box, so that there is an equalization of the compressive forces acting on the molding box walls. This makes possible the use of lighter molding boxes having lower strength values. A disadvantage associated with the foregoing is that the pressure chamber produced by the additional frame around the molding box and filling frame has to be of a correspondingly large design, which is very expensive and increases the dimensions of the molding machine. In addition, part of the compaction energy generated must be used for the pressure on the molding box from the outside.

Accordingly, it is the object of the present invention to provide a process and an apparatus for carrying out the process which makes it possible to use lightweight molding boxes of low stability wherein the pressure chamber is fitted in a sealed manner directly on the filling frame mounted on the molding box.

SUMMARY OF THE INVENTION

The foregoing object is accomplished by way of the present invention wherein a process for compacting granular molding materials and an apparatus for carrying out the process comprises exerting a pressure on the outer surface of the sidewalls of the molding box in opposition to the pressure in the mold cavity which is used to compact the granular molding material. In accordance with the process of the present invention a mold cavity is defined by the pattern plate, a molding box arranged on the molding plate, a filling frame on the molding box and a pressure chamber on the filling frame for delivering a medium under pressure to the mold cavity for compacting granular molding materials contained therein. In accordance with the specific features of the process of the present invention a first pressure is exerted on the outer surface of the sidewalls of the molding box in opposition to a second compacting pressure applied over the granular molding material within the mold cavity. The first and second pressures are independent of each other and the first pressure is exerted transversely to the second compacting pressure. The apparatus for carrying out the process of the present invention includes compression means associated with the outer surface of the peripheral walls of the mold box for applying pressure to the sidewalls in opposition to pressure in the mold cavity. In accordance with a specific feature of the present invention the compression means comprises a compression beam associated with each of the sidewalls of the molding box and means associated with the compression beam for biasing same against the sidewalls.

BRIEF DESCRIPTION OF THE DRAWINGS

The invention is described below and represented by way of example in the accompanying drawing, in which.

DETAILED DESCRIPTION

Figure 1:
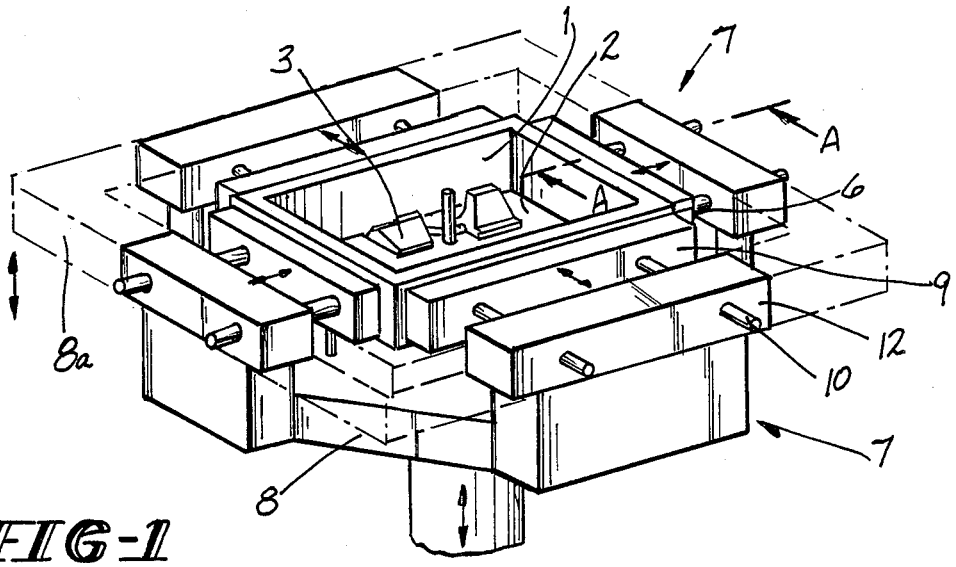
FIG. 1 shows a perspective representation of a molding box with pressure apparatus arranged at the periphery.
Figure 2:
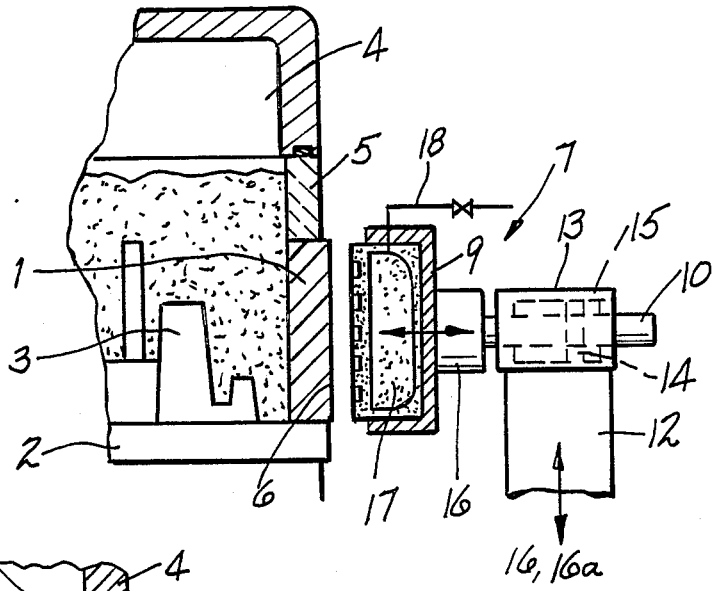
FIG. 2 shows a partial section along the line A—A of FIG. 1 in a first operating position of a pressure apparatus.
Figure 3:
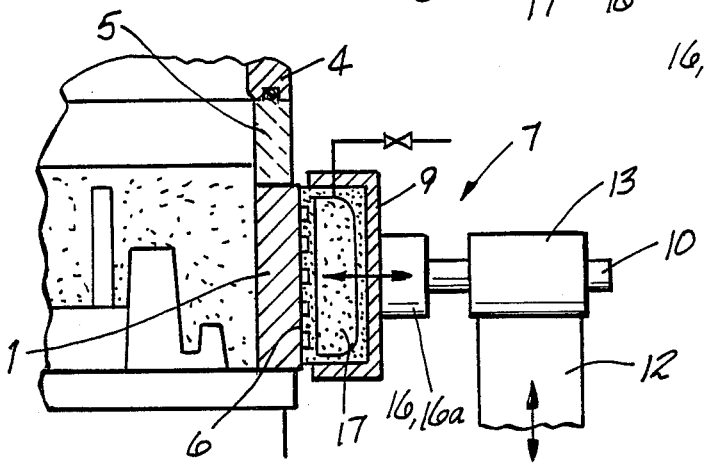
FIG. 3 shows a partial section corresponding to FIG. 2 in a second operating position.

FIG. 1 shows a molding box 1 with pattern 3 arranged on a pattern plate 2. The pressure chamber 4, partially represented in FIGS. 2 and 3, for the compaction pressure and the filling frame 5 are omitted in FIG. 1 for a clearer representation. A pressure apparatus 7 is provided for each of the peripheral outer walls 6 of the molding box 1 and the four pressure apparatus 7 are arranged on a raisable and lowerable pressure frame **8*a* (represented by dot-dashed lines in FIG. 1) or a lifting table 8. Each pressure apparatus 7 has a compressed beam 9 having substantially the same surface area as the outer walls 6, which is fastened on guide rods 10**.

The guide rods 10 are displaceably mounted in a bearing block 12. The compressed beam 9 can be displaced and pressed against the outer wall 6 of the molding box 1 by means of a positioning drive 13.

The positioning drive 13 is advantageously a double-acting cylinder, the guide rod 10, for example, simultaneously being the piston rod provided with a piston 14. The cylinder 15 is integrated in the bearing block 12.

Between the compressed beam 9 and the guide rod 10 there is arranged in each case a pressure cell 16 or a sensor **16*a* for measuring and controlling the contact force of the beam 9 on the outer wall 6 of the molding box 1**.

The compressed beam 9 has a chamber 17, to which a medium can be admitted. The medium may be, for example, water, oil, air or an integral foam. The medium is fed to the chamber 17 under pressure through a line 18. As evident from FIG. 2, the pressure chamber 4 is mounted on the molding box 1 and filling frame 5, filled with the molding sand. Subsequently, as evident from FIG. 3, the compressed beams 9 are pressed against the outer walls 6 of the molding box 1. The contact force is adjustable and is controlled via the pressure cell 16 or the sensor **16*a*. Subsequently, a pressure is generated on the surface of the molding material by the expansion of a gas in the pressure chamber 4**, as a result of which a compaction of the molding material takes place to form a casting mold.

The thereby resulting compressive forces on the molding box walls are equalized or absorbed by the contact force of the beam 9. This makes possible the use of molding boxes having lower rigidity or strength in the peripheral walls, as a result of which the latter can be produced much more cheaply and are of lighter weight.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. An apparatus for compacting granular molding material comprising: a pattern plate, a molding box having a plurality of peripheral sidewalls mounted on said pattern plate, a filling frame mounted on said peripheral sidewalls and a pressure chamber on said filling frame wherein said pattern plate, said molding box, said sidewalls and said pressure chamber together define a mold cavity for receiving said granular molding material and compression means associated with the outer surface of said plurality of peripheral sidewalls exterior of said mold cavity for applying pressure to substantially the entire area of said sidewalls in opposition to pressure in said mold cavity said compression means comprises a compression beam associated with each of said sidewalls and having substantially the same surface area as said sidewalls, motor means for biasing said compression beam toward and away from said sidewall, and a pressure sensor between said compression beam and said motor means wherein said compression beams comprise a chamber for receiving a fluid medium under pressure from a source upon the sensing of an increase in pressure within the mold cavity by said pressure sensor.

2. An apparatus according to claim 1 wherein each compression beam is mounted on guide means which are movably mounted in a bearing block.

3. An apparatus according to claim 2 wherein said bearing block includes moving means for vertically positioning the compression beams with respect to said sidewalls.

4. An apparatus according to claim 1 wherein the fluid medium is a liquid medium.

5. An apparatus according to claim 1 wherein the fluid medium is air.

6. An apparatus according to claim 1 wherein said compression beams are provided with a chamber having an integral foam therein.

* * * * *